US006188045B1

(12) United States Patent
Hansen et al.

(10) Patent No.: US 6,188,045 B1
(45) Date of Patent: Feb. 13, 2001

(54) COMBINATION OVEN WITH THREE-STAGE WATER ATOMIZER

(75) Inventors: William J. Hansen, Brookfield; Jembu K. Raghavan, Mequon, both of WI (US)

(73) Assignee: Alto-Shaam, Inc., Menomonee Falls, WI (US)

( * ) Notice: Under 35 U.S.C. 154(b), the term of this patent shall be extended for 0 days.

(21) Appl. No.: 09/541,167

(22) Filed: Apr. 3, 2000

(51) Int. Cl.[7] ..... A21B 3/04; A47J 27/04; A47J 27/16; F22B 27/16

(52) U.S. Cl. ..... 219/401; 219/400; 126/20; 239/498; 239/504

(58) Field of Search ..... 219/400, 401; 126/369, 20, 214; 99/476; 239/461, 498, 499, 500, 504

(56) References Cited

U.S. PATENT DOCUMENTS

| | | | | |
|---|---|---|---|---|
| D. 401,167 | | 11/1998 | Meister | D10/50 |
| 3,192,167 | * | 6/1965 | Ogawa et al. | 261/156 |
| 4,700,685 | * | 10/1987 | Miller | 126/20 |
| 4,884,553 | | 12/1989 | Schwarzbäcker | 126/20 |
| 5,014,679 | | 5/1991 | Childs et al. | 126/21 |
| 5,039,535 | | 8/1991 | Lang et al. | 426/233 |
| 5,199,416 | | 4/1993 | Gumienny et al. | 126/522 |
| 5,295,457 | | 3/1994 | Gumienny et al. | 122/255 |
| 5,295,589 | | 3/1994 | Riepl | 211/41 |
| 5,370,498 | | 12/1994 | Klingler | 415/223 |
| 5,462,404 | | 10/1995 | Durth | 415/183 |
| 5,530,223 | | 6/1996 | Culzoni et al. | 219/401 |
| 5,619,983 | * | 4/1997 | Smith | 126/20 |
| 5,636,622 | | 6/1997 | Urcelay Amondarain et al. | 126/20 |
| 5,657,743 | | 8/1997 | Schwarzbäcker et al. | 126/194 |
| 5,676,046 | | 10/1997 | Taber et al. | 99/340 |
| 5,710,409 | | 1/1998 | Schwarzbäcker et al. | 219/506 |
| 5,768,982 | | 6/1998 | Violi et al. | 99/476 |
| 5,771,782 | | 6/1998 | Taber et al. | 99/340 |
| 5,842,409 | | 12/1998 | Löffler et al. | 99/421 |
| 5,915,372 | | 6/1999 | Wiedemann et al. | 126/21 A |
| 6,023,050 | * | 2/2000 | Violi | 219/401 |

FOREIGN PATENT DOCUMENTS

| | | | |
|---|---|---|---|
| 4124896 | * | 1/1993 | (DE) . |
| 4131748 | * | 12/1997 | (DE) . |
| 244 538 B1 | | 11/1986 | (EP) . |
| 383366 | * | 8/1990 | (EP) . |

* cited by examiner

*Primary Examiner*—Joseph Pelham
(74) *Attorney, Agent, or Firm*—Quarles & Brady LLP

(57) ABSTRACT

A combination convection and steam oven having a three stage atomizer for breaking up supply water prior to vaporization. The atomizer includes a motor-driven fan having an atomizer cup at its hub which revolves with the fan about an axis of rotation. The atomizer cup has rectilinear or concave walls defining pockets having lengthwise slots at their corners. As the atomizer cup is rotated, supply water is fed into the cup so as to impact the inner surfaces and shear as it exits through the slots under centrifugal force, which directs the water through the fan blades. The supply water thereby is broken up by three separate actions prior to vaporization.

12 Claims, 5 Drawing Sheets

10
12
16
24
64
26
28
60
70
22
62
14
40
60
46
28
20
16

COMBINATION OVEN WITH THREE-STAGE WATER ATOMIZER

CROSS-REFERENCE TO RELATED APPLICATIONS (Not Applicable.)

STATEMENT REGARDING FEDERALLY SPONSORED RESEARCH OR DEVELOPMENT (Not Applicable.)

BACKGROUND OF THE INVENTION

The present invention relates to cooking ovens, and in particular, to combination ovens and steamers.

Combination ovens provide the ability to cook foods using steam, hot air or a combination of both. A motor driven fan is used to circulate air within a cooking chamber past electrical heating elements or gas fired heat exchange tubes. Combination ovens can be designed with or without a boiler. To produce steam within the cooking chamber, a water line feeds water into the cooking chamber near the heating elements to vaporize the water.

It is well known that the rate of thermal heat transfer increases in proportion to the surface over which the heating occurs. Thus, combination ovens typically feed the water within the inner diameter of the fan so that the water is drawn through the fan. Contact of the water with the fan blades separates the water into small droplets having an effective large surface area which can be vaporized more efficiently. To further improve thermal efficiency, some prior art combination ovens include an atomization element at the hub of the fan which is rotated by the motor. The atomization element which acts to break up the water before it is further reduced by the fan blades. This two stage atomization process produces a fine mist of water surrounding the heating elements.

One type of two stage atomizer is disclosed in U.S. Pat. No. 5,014,679, wherein the atomizer element is a cylindrical drum forming a trough with an open end into which the water is fed. As the drum is rotated, centrifugal force directs the water to pass through the open end where it is broken up by shear forces at the circular edge. The broken up water is then directed radially outward to a fan. A variation on this design includes a perforated cylindrical drum with centrifugal force directing the water out of the perforations. The water is broken up more finely in this design due to increased shearing of the water by the perforations.

An alternative design is disclosed in U.S. Pat. No. 5,530,223. This patent discloses a combination oven in which the water is directed at an outer surface of a pre-atomizer as it is rotated. The pre-atomizer is a sphere, a hemisphere or a plate having no openings. The contact of the water with the outer surface of the rotating atomizer element preliminarily breaks up the water before it is drawn into the fan. However, in this design, there is relatively little shear forces acting on the impinging water, compared to the perforated drum, such that the water is not as finely broken up.

Accordingly, a combination steam and convection oven is desired that provides improved atomization of water.

SUMMARY OF THE INVENTION

The present invention provides a combination steam and convection oven for preparing food having a three stage atomizer providing highly energy efficient steaming operation. An atomizer cup preliminarily breaks up impinging water at inner surfaces before it is sheared through opening in the walls and drawn into and through a fan.

Specifically, the atomizer includes a fan rotating about an axis to dispel air radially outward. The fan has an open face providing access to a fan interior. Heating elements surround the fan in the path of the dispelled air. A cup is attached to the fan along the axis within the fan interior to rotate with the fan. The cup has an open face providing access to a cup interior defined by axially extending cup walls, which receives water from a water line. The cup walls vary in distance from the axis as a function of an angle about the axis. At least one cup wall includes an opening through which the water in the cup interior passes. In this way, the cup walls provide impact surfaces striking and atomizing water introduced through the open face of the cup to the cup interior. The edges of the opening causes shearing of the water so as to further break up the water passing through the opening before contacting blades of the fan.

In one aspect of the invention, the cup can include a plurality of openings. The openings can be perforations, preferably however, the openings are slots disposed along the union of adjacent walls.

In another aspect of the invention, the atomizer cup has rectilinear walls defining a rectangular cross-sections. The walls may, however, have an N-sided cross-section where N is between 3 and 10. In this way, the walls can be configured to extend radially outward so that adjacent walls define water receiving pockets. The walls can also be curved to define concave inward pockets for receiving water. In either case, water feed into the cup interior is impacted and agitated by the cup walls, particularly at their edges, before the water exits the openings.

In one preferred form, the present invention provides a convection food oven having improved steam generating capabilities. The oven includes an oven enclosure containing a water line and at least one heating element. A motor-driven radial fan, positioned near the heating element, rotates about a rotation axis. An atomizer cup is attached to a hub of the fan and has a plurality of rectilinear walls with slotted edges. As such, water from the water line is atomized in three stages. In the first stage, impinging water is broken up by contact with the inside surfaces of the of walls. In the second stage, the water is sheared by passing through the slots. And, in the third stage, the water is further atomized by contacting the fan blades.

These and still other advantages of the present invention will be apparent from the description of the preferred embodiments which follow.

DETAILED DESCRIPTION OF THE PREFERRED EMBODIMENTS

Figure 1:
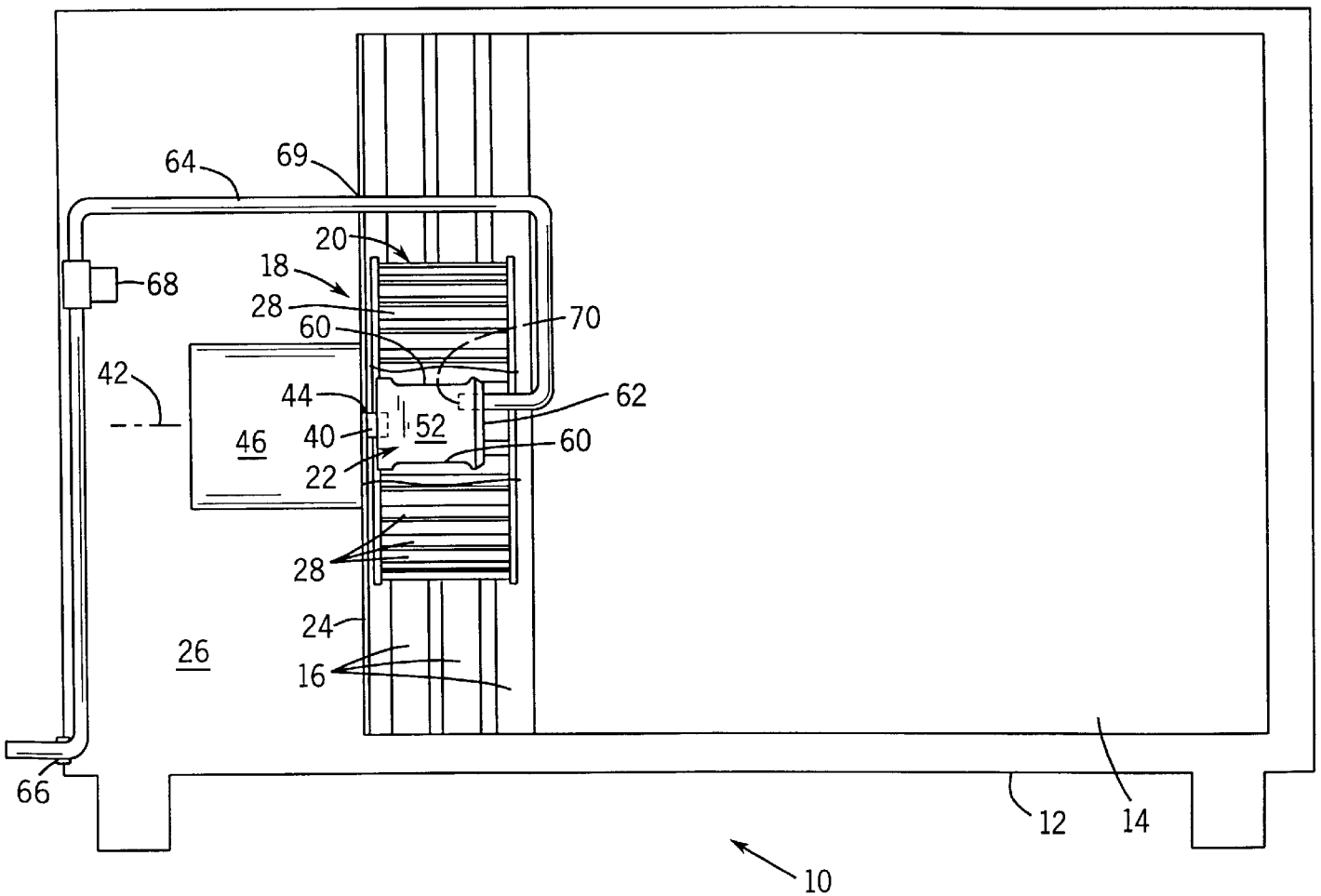
FIG. 1 is a side view of an atomizer of the present invention and a drive unit and water feed within a combination convection and steam oven, the drive unit and water feed shown schematically.
Figure 2:
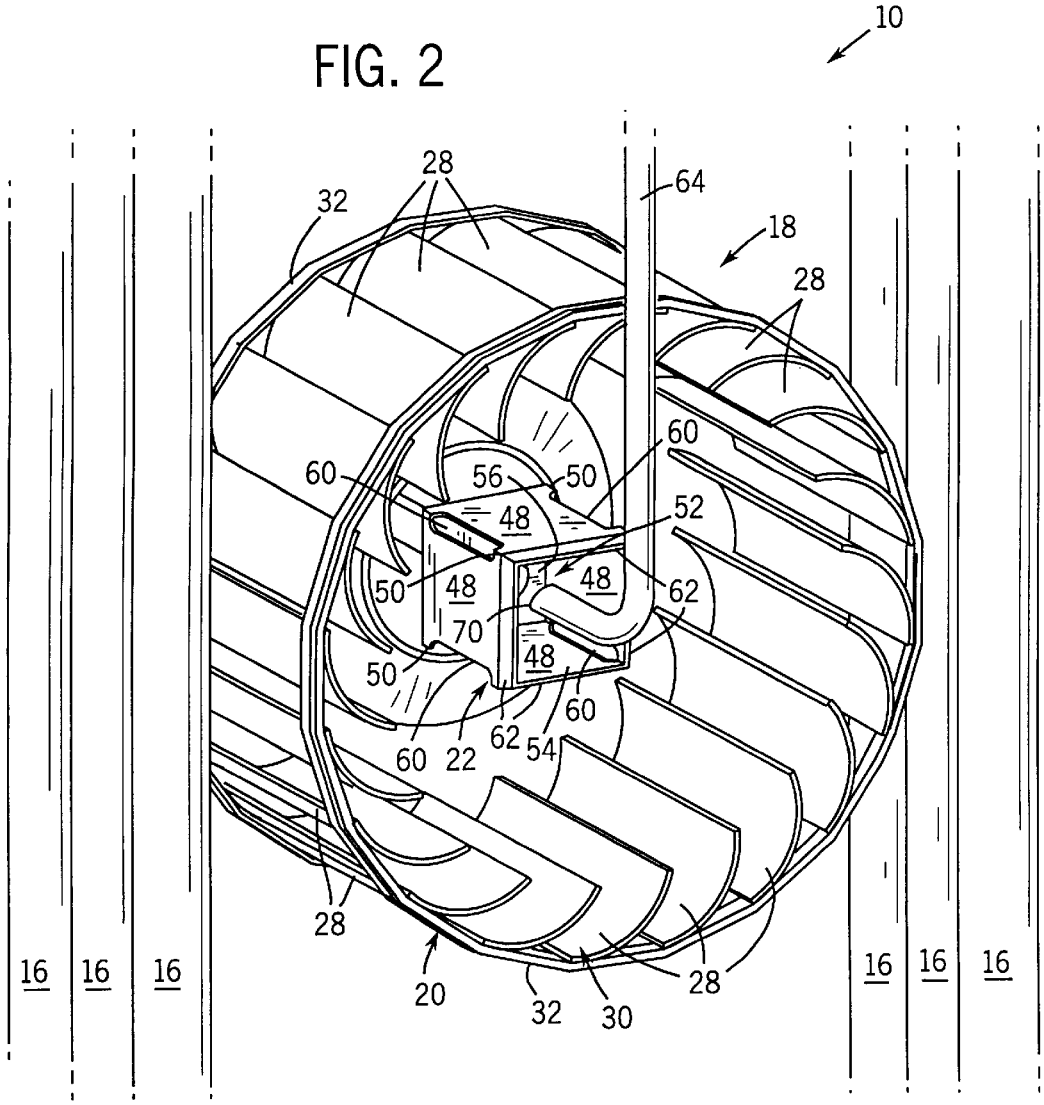
FIG. 2 is an enlarged perspective view of an atomizer cup, fan, a water line and heating elements of the atomizer of FIG. 1.
Figure 3:
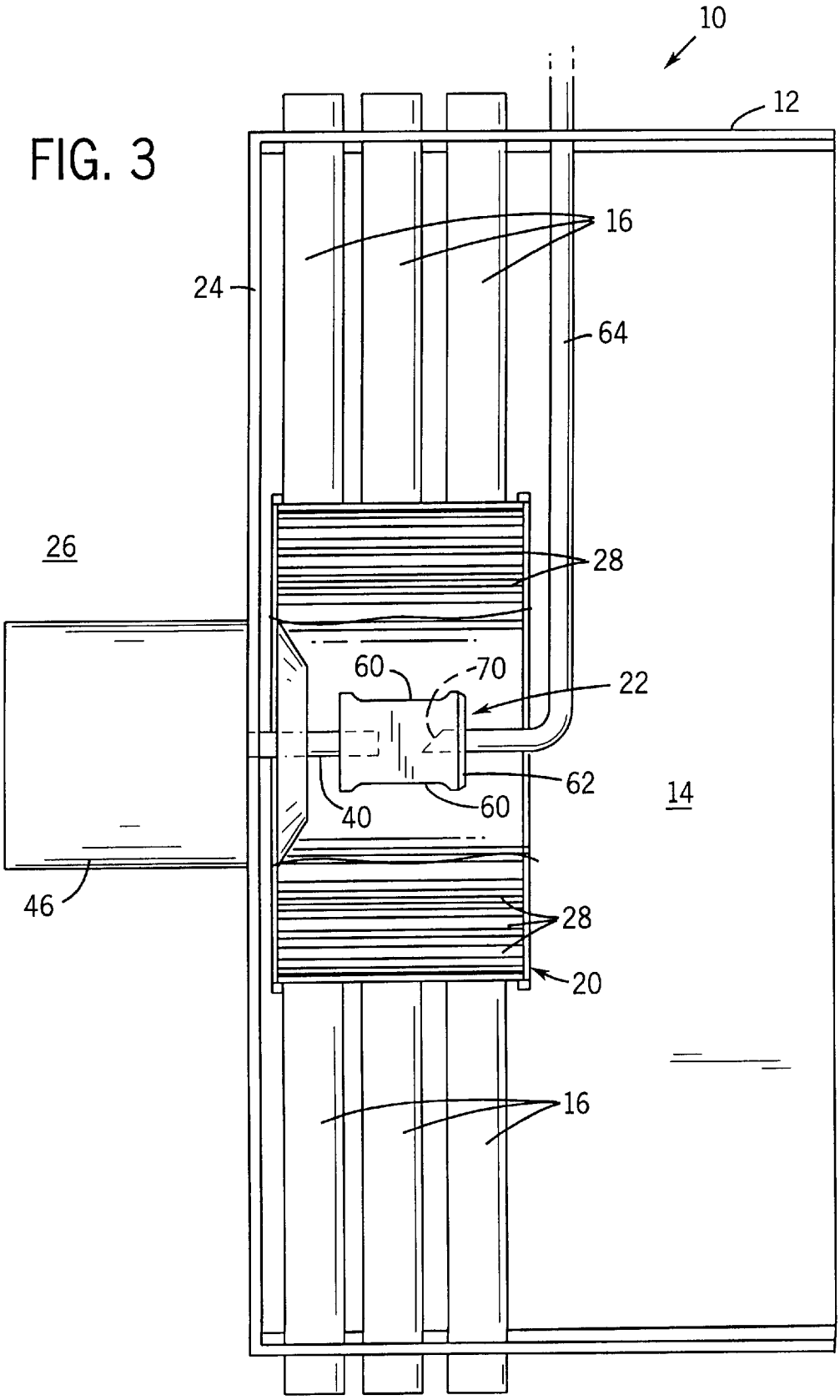
FIG. 3 is a side view of the atomizer of FIG. 2, shown with one set of heating elements removed.
Figure 4:
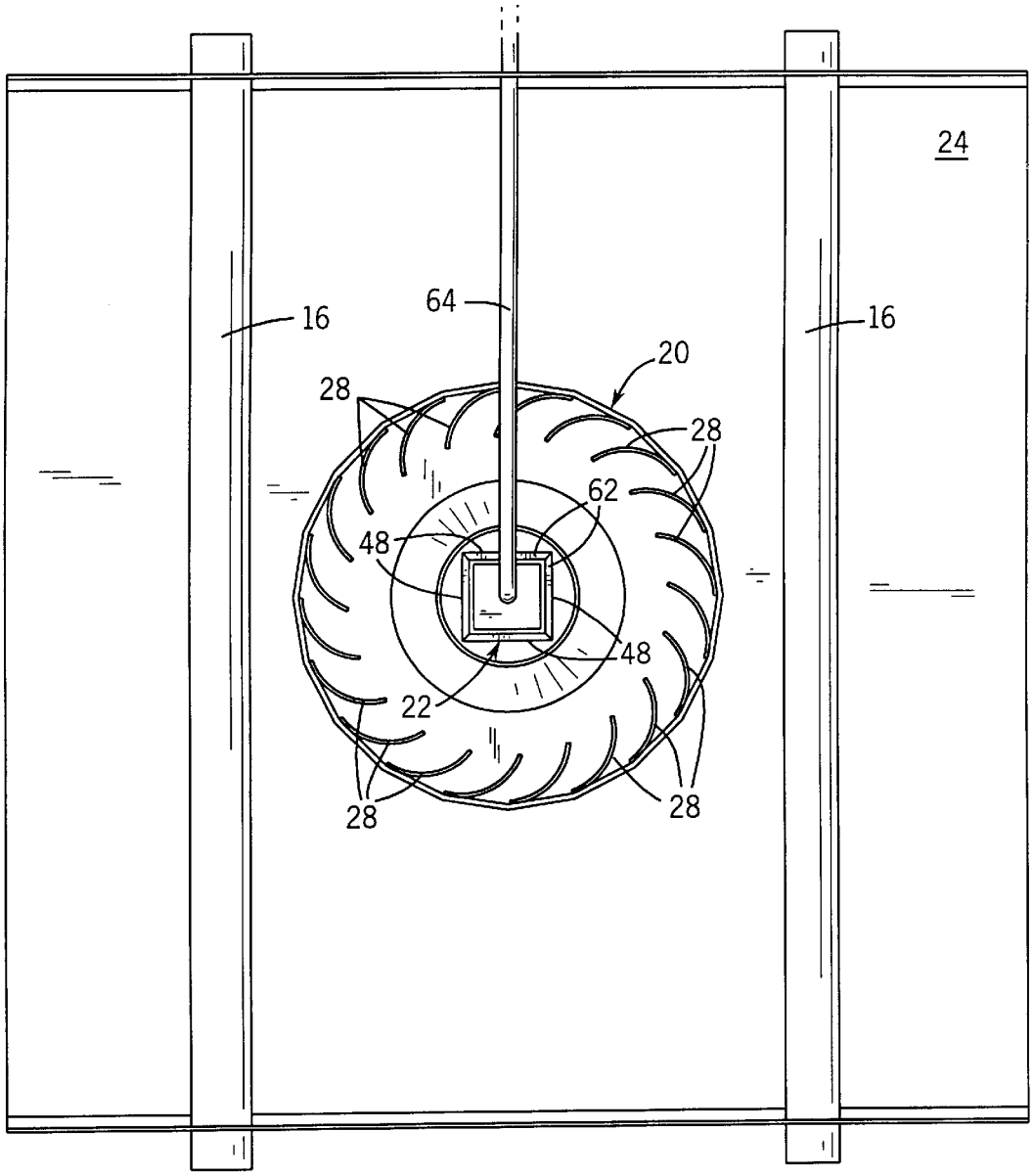
FIG. 4 is front view of the atomizer.

Referring to FIG. 1, a combination convention and steam cooking oven 10 includes an enclosure 12 defining a cooking chamber 14 for containing foodstuffs. The cooking chamber also includes heating elements 16 as well as an atomizer 18 comprising a motor-operated fan 20 and an atomizer cup 22 at one side of the cooking chamber 14. The heating elements 16 are conduits of a metallic material through which gas heated by the oven burners (not shown) circulates. Preferably, the heating elements 16 include two sets of three conduits extending in close proximity to the outer diameter of the fan 20, preferably at each side, in front of and behind the fan 20. Alternatively, the heating elements 16 may be suitable solid resistive heating elements. The heating elements 16, fan 20 and atomizer cup 22 are located adjacent to a partition 24 separating the cooking chamber 14 from an electronics area 26.

The fan 20 is a squirrel cage design having a plurality of inwardly cupped blades 28 attached at a fixed end 30 to parallel circular rims 32. The blades 28 are oriented to draw air in through an open side 34 and expel air radially outward toward the heating elements 16 when rotated clockwise. Opposite the open side 34, the fan 20 includes a wall 36 having a concentric opening 38 for suitably mounting the fan 20 to a motor shaft 40 positioned along a rotation axis 42.

The motor shaft 40 also extends through an opening 44 in the partition 24 back to the electronics area 26 in which a suitable electric motor 46 is disposed. Preferably, the motor 46 is mounted by suitable bracketry (not shown) to the partition 24. The motor 46 is coupled to a control module (not shown) having a suitable keypad user interface (not shown) viewable from the front exterior of the enclosure 12 for setting cooking time and temperature.

The motor shaft 40 also mounts the atomizer cup 22 at the center of the fan 20. In a preferred embodiment, the atomizer cup 22 includes a plurality of rectilinear walls 48 joined at edges 50 defining a cup volume 52 having an open side 54 and an opposite walled side 56. The walled side 56 includes an opening 58 through which the motor shaft 40 is inserted. The atomizer cup 22 can be mounted to the motor shaft 40 by any suitable connection, such as a press-fit, threaded fastener or slot pin and connection. In one preferred embodiment, the atomizer cup 22 includes four walls 48 joined at right angles. Preferably, the walls 48 have lengthwise slots 60 at the edges and an inwardly tapered lip 62 at the opening sides 54 to provide a trough for presenting water at the inner surfaces of the walls 48 from exiting out the open side 54 of the atomizer cup 22. The slots 60 are preferably sized large enough so as not be easily clogged by buildup of calcium deposits from the water. The walls 48 are preferably made of a material resistant to the affects of heat and corrosion, such as stainless steel.

A water line 64 of suitable tubing extends from a fitting 66 within the electronics area 26 of the enclosure 12 at which a water supply line (not shown) is attached to a flow control valve 68, such as a solenoid, coupled to the electronic control module (not shown). From the control valve 68, the water line 64 continues through an opening 69 (see FIG. 1) in the partition 24 into the cooking chamber 14 in a suitable path to avoid interfering with the fan 20. The water line 64 terminates at an open end 70 within the cup volume 52 of the atomizer cup 22.

The combination oven 10 can be used solely for convection cooking. In this case, the flow control valve 68 remains dosed so that no water is fed to the atomizer 18. The motor 46 rotates the fan 20 to pick up and circulate heat radiating from the energized heating elements 16. When steam cooking is desired, the flow control valve 68 is operated to allow supply water to flow through the water line 64 to the atomizer 18. The flow control valve 68 can be controlled to provide intermittent or steady stream flow of water through the water line 64. In either case, the flow rate is controlled to provide only the volume of water that can be immediately vaporized by the heating elements 16 so that overflowing water does not accumulate at the bottom of the cooking chamber 14.

As the atomizer cup 22 and fan 20 are rotated, the impinging water is broken up and directed past the heating elements 16. The atomizer cup 22 and fan 20 act to break up the water in three stages. First, water leaving the water line 64 impinges on the inside surface of the atomizer cup walls 48. The rotating rectilinear walls 48 disrupt and agitate the impinging water to a greater extent than smooth curvilinear surfaces. Second, the centrifugal force generated by rotation directs the water within the cup volume 52 radially outward to the edge slots 60. As the water passes through the slots 60 it is sheared by its edges. Third, the fan 20 draws this water into contact with the revolving blades 28, which further shears the water. The water is broken up to increase its surface area as it passes by the heating elements 16. According to known heat transfer principles, increasing surface area of a body increases the rate at which heat is transferred to that body. Here, the water flowing from the water line 64 will be more efficiently vaporized to steam by the heating elements 16 due to the atomization of the water. Thus, the heating elements will consume less energy while generating a given amount of steam.

Figure 5:
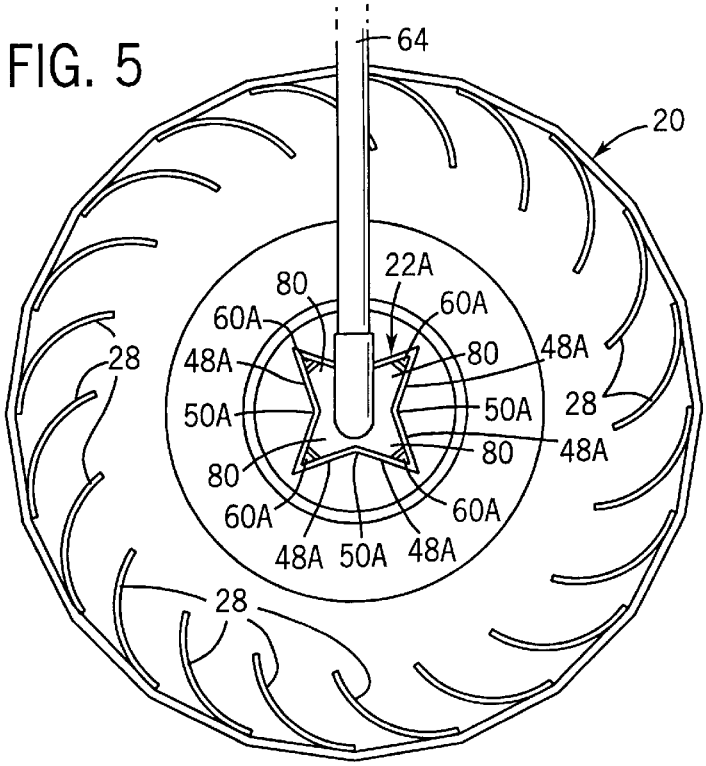
FIG. 5 is an enlarged front view of an alternate embodiment of the atomizer cup.

FIG. 5 shows an alternate embodiment of the oven 10A with an atomizer cup 22A having six rectilinear walls 48A joined at their edges 50A at alternating obtuse and acute included angles. The walls separated by the acute included angles define pockets 80 in which the impinging water can be captured and agitated before it is directed out edgewise slots 60A to the fan 20. This embodiment provides additional edges and surfaces for contacting and breaking up the impinging water prior to exiting through the slots 60.

Figure 6:
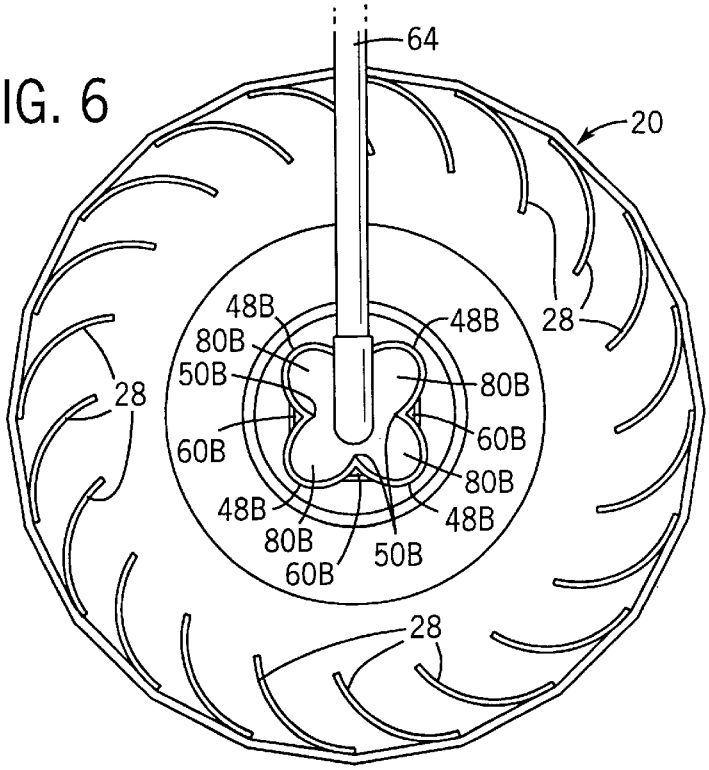
FIG. 6 is an enlarged front view of another embodiment of the atomizer cup.

FIG. 6 shows another embodiment of an atomizer cup 22B having four arcuate walls 48B joined at their edges 50B. The arcuate walls 48B define in concave interior pockets 80B, which capture and agitate water fed into the atomizer cup 22B before it is directed out slots 60B. This embodiment, as well as that shown in FIG. 5, preferably includes an inwardly directed rim (not shown) at the open side of the atomizer cup for retaining water.

The present invention may include other aspects not specifically delineated in the aforementioned preferred embodiments. For example, the atomizer cup may have more or less walls of the same or different sizes to provide other suitable configurations. Thus, the above in no way is intended to limit the scope of the invention. Accordingly, in order to apprise the public of the full scope of the present invention, reference must be made to the following claims.

What is claimed is:

1. An atomizer for use in a combination steam and convection oven for the preparation of food having a heating element and a water line delivering water, the atomizer comprising:

a fan rotating about an axis to dispel air radially therefrom and positioned to be surrounded by the heating elements in a path of the dispelled air, the fan having an open face providing access to a fan interior; and a cup attached at the axis to the fan within the fan interior to rotate therewith, the cup having an open face providing access to a cup interior defined by axially extending cup walls receiving the water from the water line, wherein at least one cup wall includes an opening through which the water in the cup interior may pass and the cup walls vary in distance from the axis as a function of an angle about the axis;

whereby the cup walls provide impact surfaces striking and atomizing water introduced through the open face of the cup to the cup interior and whereby edges of the opening causes shearing of the water so as to further break up the water passing through the opening before contacting blades of the fan.

2. The device of claim 1, wherein the cup walls are rectilinear.

3. The device of claim 2, wherein there are four cup walls forming essentially right angles therebetween.

4. The device of claim 2, wherein the cup walls have an N-sided cross-section transverse to the axis, wherein N is between 3 and 10.

5. The device of claim 2, wherein the cup walls extend radially outward so that adjacent walls define water receiving pockets.

6. The device of claim 1, wherein the cup walls are concave inward joined at axially edges to define concave water receiving pockets.

7. The device of claim 1, wherein the opening is a slot.

8. The device of claim 7, wherein the opening is disposed along the union of adjacent cup walls.

9. The device of claim 8, having a slot at the union of each set of adjacent cup walls.

10. The device of claim 1, wherein the cup walls define an inwardly projecting rim at the open face.

11. A convection food oven having steam generating capabilities, comprising:

an oven enclosure containing a water line and at least one heating element;

a radial fan positioned proximate the at least one heating element having a hub and rotating about a rotation axis; and an atomizer cup attached at the hub and rotating about the rotation axis, the atomizer cup having a plurality of rectilinear walls extending parallel to the rotation axis and having slotted edges;

whereby water from the water line is atomized in three stages, the first stage being water impinging the atomizer cup at inner surfaces of the plurality of walls, the second stage being water passing through the slots and the third stage being water contacting blades of the fan.

12. A combination convection and steam food cooking oven, comprising:

an oven housing defining a cooking chamber and an electronics cabinet;

heating elements disposed in the cooking chamber;

a water line;

a fan rotating about an axis to dispel air radially therefrom and positioned to be surrounded by the heating elements in a path of the dispelled air, the fan having an open face providing access to a fan interior and a hub at the axis; and an atomizer cup fixed at the fan hub having cup walls defining a plurality of substantially concave inward surfaces.

* * * * *